US011420441B2

(12) United States Patent
Inoue et al.

(10) Patent No.: US 11,420,441 B2
(45) Date of Patent: Aug. 23, 2022

(54) PRINTING APPARATUS AND PRINTING METHOD

(71) Applicant: Brother Kogyo Kabushiki Kaisha, Nagoya (JP)

(72) Inventors: Haru Inoue, Nagoya (JP); Hiroto Sugahara, Ama (JP); Taro Nagano, Nagoya (JP); Daiki Kato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 19 days.

(21) Appl. No.: 17/011,596

(22) Filed: Sep. 3, 2020

(65) Prior Publication Data

US 2021/0060951 A1 Mar. 4, 2021

(30) Foreign Application Priority Data

Sep. 4, 2019 (JP) ..... JP2019-161540

(51) Int. Cl.
*B41J 2/155* (2006.01)
*B41J 2/14* (2006.01)

(52) U.S. Cl.
CPC ..... *B41J 2/155* (2013.01); *B41J 2/14201* (2013.01); *B41J 2002/14491* (2013.01); *B41J 2202/17* (2013.01)

(58) Field of Classification Search
CPC ..... B41J 2/155; B41J 2/14201; B41J 2002/14491; B41J 2202/17; B41J 2/2103;
(Continued)

(56) References Cited

U.S. PATENT DOCUMENTS 7,722,145 B2 5/2010 Kubota
10,464,319 B2 11/2019 Hatta
(Continued)

FOREIGN PATENT DOCUMENTS

JP S57-36682 A 2/1982
JP 2008-162261 A 7/2008
JP 2019-064151 A 4/2019

OTHER PUBLICATIONS

IP.com search #1 (Year: 2021).*
(Continued)

*Primary Examiner* — Lisa Solomon
(74) *Attorney, Agent, or Firm* — Banner & Witcoff, Ltd.

(57) ABSTRACT

A printing apparatus includes: power supply circuits including at least first and second power supply circuits; a head including nozzles, the nozzles forming groups arranged in a first direction, each of the groups including nozzle arrays arranged in the first direction, each of the nozzle arrays extending in a second direction intersecting with the first direction, and each of the nozzles being associated with any of the power supply circuits; and a memory storing information. The information indicates correspondence relationships between the nozzles and the power supply circuits, between the nozzles and the groups, and between the nozzles and the nozzle arrays. Printing is performed by driving the head based on the information. The groups include a first group and a second group adjacent to each other in the first direction. The first group includes a first nozzle array adjacent to the second group in the first direction.

10 Claims, 12 Drawing Sheets

(58) Field of Classification Search
CPC ..... B41J 2202/21; B41J 2/04548;
B41J 2/04586; B41J 2/04508
See application file for complete search history.

(56) References Cited

U.S. PATENT DOCUMENTS

| | | | |
|---|---|---|---|
| 2008/0158276 | A1 | 7/2008 | Kubota |
| 2017/0282545 | A1 | 10/2017 | Muto |
| 2019/0099999 | A1 | 4/2019 | Hatta |
| 2020/0039213 | A1 | 2/2020 | Hatta |

OTHER PUBLICATIONS

IP.com search #2 (Year: 2021).*
IP.com search #3 (Year: 2021).*
IP.com search #4 (Year: 2021).*
Jan. 22, 2021—(EP) Extended EP Search Report—App 20192529.
4.

* cited by examiner

Fig. 8

T

| NOZZLE ID | COLUMN ID | ROW ID | GROUP ID | POWER SUPPLY CIRCUIT ID |
|---|---|---|---|---|
| n0001 | c01 | r01 | g10 | v01 |
| n0002 | c01 | r02 | g10 | v01 |
| ⋮ | ⋮ | ⋮ | ⋮ | ⋮ |
| n0024 | c01 | r24 | g10 | v01 |
| n0025 | c02 | r01 | g10 | v01 |
| ⋮ | ⋮ | ⋮ | ⋮ | ⋮ |
| n0048 | c02 | r24 | g10 | v01 |
| ⋮ | ⋮ | ⋮ | ⋮ | ⋮ |
| n0217 | c10 | r01 | g10 | v01 |
| ⋮ | ⋮ | ⋮ | ⋮ | ⋮ |
| n0240 | c10 | r24 | g10 | v01 |
| n0241 | c11 | r01 | g20 | v02 |
| ⋮ | ⋮ | ⋮ | ⋮ | ⋮ |
| n0480 | c20 | r24 | g20 | v02 |
| n0481 | c21 | r01 | g30 | v03 |
| ⋮ | ⋮ | ⋮ | ⋮ | ⋮ |
| n0720 | c30 | r24 | g30 | v03 |
| n0721 | c31 | r01 | g40 | v03 |
| ⋮ | ⋮ | ⋮ | ⋮ | ⋮ |
| n0960 | c40 | r24 | g40 | v03 |
| n0961 | c41 | r01 | g50 | v03 |
| ⋮ | ⋮ | ⋮ | ⋮ | ⋮ |
| n1200 | c50 | r24 | g50 | v03 |
| n1201 | c51 | r01 | g60 | v04 |
| ⋮ | ⋮ | ⋮ | ⋮ | ⋮ |
| n1440 | c60 | r24 | g60 | v04 |
| n1441 | c61 | r01 | g70 | v05 |
| ⋮ | ⋮ | ⋮ | ⋮ | ⋮ |
| n1680 | c70 | r24 | g70 | v05 |

PRINTING APPARATUS AND PRINTING METHOD

CROSS REFERENCE TO RELATED APPLICATION

The present application claims priority from Japanese Patent Application No. 2019-161540 filed on Sep. 4, 2019, the disclosure of which is incorporated herein by reference in its entirety.

BACKGROUND

Field of the Invention

The present disclosure relates to a printing apparatus configured to discharge ink from nozzles and a printing method.

Description of the Related Art

There is known an ink-jet head driving apparatus including: actuators provided for respective nozzles and configured to discharge ink from the nozzles by an amount corresponding to a driving signal; a storage or memory configured to store correction data by which the ink discharge amounts from the respective nozzles are leveled; a selecting section configured to select one driving signal from among driving signals based on the correction data; and a driving section configured to output the selected driving signal to the actuators. In this ink-jet head driving apparatus, the nozzles of the ink-jet head are classified into groups depending on ink discharge amount characteristics of the nozzles. Driving voltage is corrected for each of the groups to make a density difference at a boundary between the groups inconspicuous.

SUMMARY

However, in order to correct the driving voltage for each of the groups, a power supply circuit of the ink-jet head driving apparatus needs to be configured so that an output voltage value is adjustable. Making the output voltage value of the power supply circuit adjustable increases manufacturing cost.

In a printing apparatus having an ink-jet head in which nozzles are classified into groups depending on discharge characteristics, an object of the present disclosure is to reduce a density difference at a boundary between the groups without adjusting an output voltage value of a power supply circuit.

According to a first aspect of the present disclosure, there is provided a printing apparatus including: a plurality of power supply circuits including at least a first power supply circuit and a second power supply circuit; a head including a plurality of nozzles, the nozzles forming a plurality of groups arranged in a first direction, each of the groups including a plurality of nozzle arrays arranged in the first direction, each of the nozzle arrays extending in a second direction intersecting with the first direction, each of the nozzles being associated with any of the power supply circuits; and a memory storing information indicating: a correspondence relationship between the nozzles and the power supply circuits; a correspondence relationship between the nozzles and the groups; and a correspondence relationship between the nozzles and the nozzle arrays, wherein: printing is performed by driving the head based on the information; the groups include a first group and a second group adjacent to each other in the first direction; the first group includes a first nozzle array adjacent to the second group in the first direction; and the information indicates that a plurality of nozzles that are associated with the first group include a plurality of nozzles associated with the first power supply circuit and a plurality of nozzles associated with the second power supply circuit, and indicates that a plurality of nozzles associated with the first nozzle array include some of the nozzles associated with the second power supply circuit.

According to the information stored in the memory provided for the printing apparatus according to the first aspect of the present disclosure, the nozzles associated with the first group include the nozzles associated with the first power supply circuit and nozzles associated with the second power supply circuit, and the nozzles associated with the first nozzle array include some of the nozzles associated with the second power supply circuit. Namely, the nozzles associated with the first power supply circuit and the nozzles associated with the second power supply circuit are mixed in the first nozzle array. This reduces a difference in density at a boundary between the first group and the second group without adjusting the output voltage of the first power supply circuit and the second power supply circuit.

According to a second aspect of the present disclosure, there is provided a printing apparatus, including: a plurality of power supply circuits including at least a first power supply circuit and a second power supply circuit; a head including a plurality of nozzles, the nozzles forming a plurality of groups arranged in a first direction, each of the nozzles being associated with any of the power supply circuits; and a memory storing information indicating a correspondence relationship between the nozzles and the power supply circuits and a correspondence relationship between the nozzles and the groups, wherein: printing is performed by driving the head based on the information; the groups include a first group, a second group, and a third group, the second and third group being adjacent to the first group at both sides in the first direction; and the information indicates that a plurality of nozzles associated with the first group include at least one nozzle associated with the first power supply circuit and at least one nozzle associated with the second power supply circuit, that all nozzles associated with the second group are associated with the first power supply circuit, and that all nozzles associated with the third group are associated with the second power supply circuit.

According to the information stored in the memory provided for the printing apparatus according to the second aspect of the present disclosure, the nozzles associated with the first power supply circuit and the nozzles associated with the second power supply circuit are mixed in the first nozzle group that is a boundary between the second group and the third group. This reduces a difference in density in the first nozzle group that is the boundary between the second group and the third group without adjusting the output voltage of the first power supply circuit and the second power supply circuit.

According to a third aspect of the present disclosure, there is provided a printing apparatus, including: a plurality of power supply circuits including at least a first power supply circuit and a second power supply circuit; a head including a plurality of nozzles, the nozzles forming a plurality of nozzle arrays arranged in a first direction, each of the nozzle arrays extending in a second direction intersecting with the first direction, each of the nozzles being associated with any of the power supply circuits; and a memory storing information indicating a correspondence relationship between the nozzles and the power supply circuits and a correspondence relationship between the nozzles and the nozzle arrays, wherein printing is performed by driving the head based on the information, wherein: the information indicates that the nozzle arrays include: at least one boundary nozzle array formed by a plurality of nozzles associated with the first power supply circuit and a plurality of nozzles associated with the second power supply circuit; at least one nozzle array positioned at one side in the first direction with respect to the at least one boundary nozzle array and formed only by the nozzles associated with the first power supply circuit; and at least one nozzle array positioned at the other side in the first direction with respect to the at least one boundary nozzle array and formed only by the nozzles associated with the second power supply circuit.

According to the information stored in the memory provided for the printing apparatus according to the third aspect of the present disclosure, the boundary nozzle array in which the nozzles associated with the first power supply circuit and the nozzles associated with the second power supply circuit are mixed, the nozzle array that is positioned at one side in the first direction of the boundary nozzle array and that only includes the nozzles associated with the first power supply circuit, and the nozzle array that is positioned at the other side in the first direction of the boundary nozzle array and that only includes the nozzles associated with the second power supply circuit are formed. This reduces a difference in density at the boundary nozzle array without adjusting the output voltage of the first power supply circuit and the second power supply circuit.

According to a fourth aspect of the present disclosure, there is provided a printing method, including: discharging a liquid from a head onto a medium, the head including: a plurality of power supply circuits that include at least a first power supply circuit and a second power supply circuit; and a plurality of nozzles, the nozzles forming a plurality of groups arranged in a first direction, each of the groups including a plurality of nozzle arrays arranged in the first direction, each of the nozzle arrays extending in a second direction intersecting with the first direction, each of the nozzles being associated with any of the power supply circuits; and moving one of the medium and the nozzles relative to the other of the medium and the nozzles, wherein: the groups include a first group and a second group adjacent to each other in the first direction; the first group includes a first nozzle array adjacent to the second group in the first direction; a plurality of nozzles belonging to the first group include a plurality of nozzles associated with the first power supply circuit and a plurality of nozzles associated with the second power supply circuit; and the nozzles belonging to the first nozzle array include some of the nozzles associated with the second power supply circuit.

In the head used in the printing method according to the fourth aspect of the present disclosure, the first group includes the nozzles associated with the first power supply circuit and the nozzles associated with the second power supply circuit, and the first nozzle array includes some of the nozzles associated with the second power supply circuit. Namely, the nozzles associated with the first power supply circuit and the nozzles associated with the second power supply circuit are mixed in the first nozzle array. This reduces a difference in density at a boundary between the first group and the second group without adjusting the output voltage of the first power supply circuit and the second power supply circuit.

BRIEF DESCRIPTION OF THE DRAWINGS

FIG. 8 depicts an example of information stored in a non-volatile memory of the head of this embodiment.

DESCRIPTION OF THE EMBODIMENTS

Referring to FIGS. 1 to 9, a printing apparatus according to an embodiment of the present disclosure is explained below.

Figure 1:
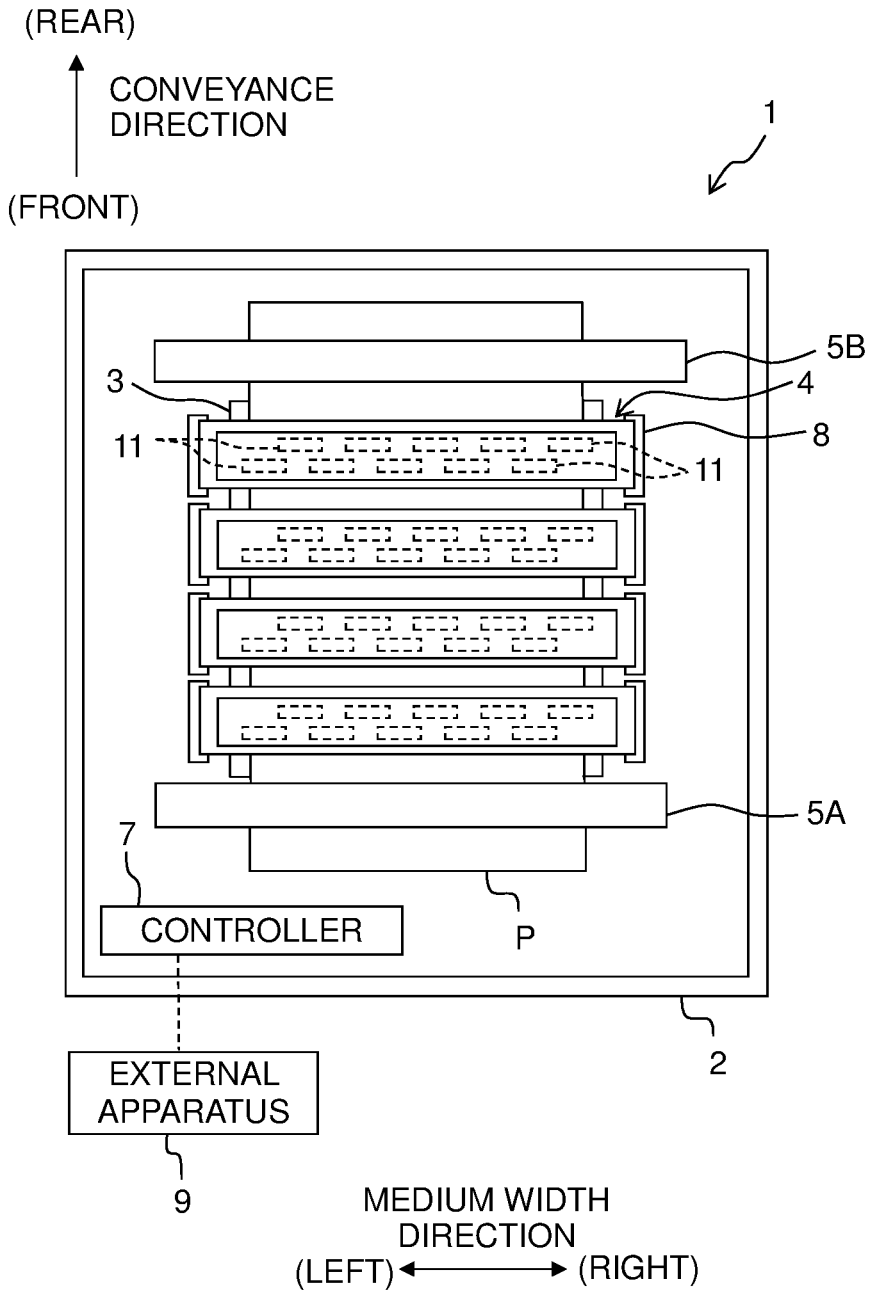
FIG. 1 is a plan view of an example of a main configuration of a printing apparatus of this embodiment.

In FIG. 1, an upstream side in a conveyance direction of a sheet-like medium P (for example, paper, cloth, etc.) is defined as a front side of a printing apparatus 1, and a downstream side in the conveyance direction of the medium P is defined as a rear side of the printing apparatus 1. A direction parallel to a surface on which the medium P is conveyed (a surface parallel to a paper surface of FIG. 1) and orthogonal to the conveyance direction is defined as a medium width direction. A left side in FIG. 1 is a left side of the printing apparatus 1, and a right side in FIG. 1 is a right side of the printing apparatus 1. A direction perpendicular to the surface on which the medium P is conveyed (a direction perpendicular to the paper surface of FIG. 1) is defined as an up-down direction of the printing apparatus 1. A front surface of FIG. 1 is an upper side, and a back surface of FIG. 1 is a lower side. In the following, the explanation is made by appropriately using the front, rear, left, right, up (upper), and down (lower) directions. The medium width direction is an exemplary "first direction" of the present disclosure, and the conveyance direction is an exemplary "second direction" of the present disclosure.

As depicted in FIG. 1, the printing apparatus 1 includes a casing 2, a platen 3, four line heads 4, two conveyance rollers 5A and 5B, and a controller 7.

The platen 3 is placed flatly in the casing 2. The medium P is placed on an upper surface of the platen 3. The four line heads 4 are disposed above the platen 3 such that they are arranged in a front-rear direction. The conveyance roller 5A is disposed on the front side of the platen 3 and the conveyance roller 5B is disposed on the rear side of the platen 3. The two conveyance rollers 5A and 5B are driven by an unillustrated motor, which causes the two conveyance rollers 5A and 5B to convey the medium P on the platen 3 rearward. Although the printer 1 includes the four line heads 4 in this embodiment, the number of the line leads 4 is not limited to four.

Figure 3:
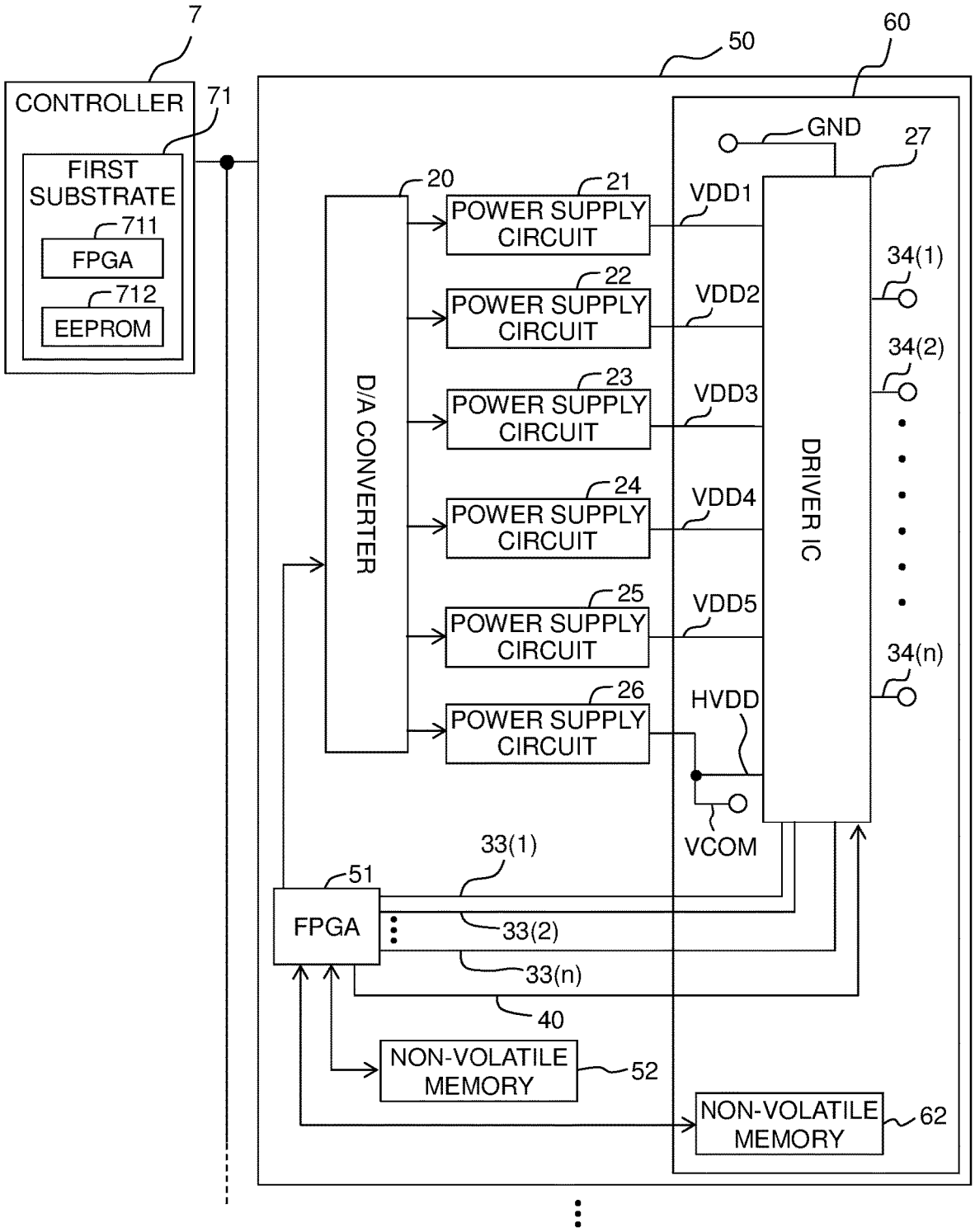
FIG. 3 is a block diagram of an example of a configuration including a second substrate that is provided in the head and a flexible circuit board that is connected to the second substrate of this embodiment.

As depicted in FIG. 3, the controller 7 includes a first substrate 71. The first substrate 71 includes a Field Programmable Gate Array (FPGA) 771, a Read Only Memory (ROM, not depicted in the drawings), a Random Access Memory (RAM, not depicted in the drawings), an Electrically Erasable Programmable Read-Only Memory (EEPROM) 712, and the like. The controller 7 interacts or intercommunicates with an external apparatus 9, such as a personal computer. When the controller 7 receives an instruction from the external apparatus 9 or an operation section (not depicted) provided for the printing apparatus 1, the controller 7 controls the operation of the line heads 4 and the operation of the conveyance rollers 5A, 5B in accordance with a program(s) stored in the ROM. A Central Processing Unit (CPU) or a Microprocessor Unit (MPU) may be used instead of the FPGA 711.

For example, the controller 7 controls the motor, which drives the driving rollers 5A and 5B, to cause the conveyance rollers 5A and 5B to convey the medium P in the conveyance direction. Further, the controller 7 controls each line head 4 to discharge ink onto the medium P. Accordingly, an image is printed on the medium P. The medium P may be a roll-shaped medium including a supply roll that has an upstream end in the conveyance direction and a recovery roll that has a downstream end in the conveyance direction. In this case, the supply roll may be attached to the conveyance roller 5A at the upstream side in the conveyance direction. The recovery roll may be attached to the conveyance roller 5B at the downstream side in the conveyance direction. Or, the medium P may be a roll-shaped medium only including the supply roll that has the upstream end in the conveyance direction. In that case, the supply roll may be attached to the conveyance roller 5A at the upstream side in the conveyance direction.

The casing 2 includes four head holding portions 8 corresponding to the four line heads 4. The head holding portions 8 are arranged above the platen 3 in a position between the conveyance rollers 5A and 5B. The head holding portions 8 are arranged in the front-rear direction. Each of the head holding portions 8 holds the corresponding one of the ink-jet heads 4.

The four line heads 4 respectively discharge inks of four colors of cyan (C), magenta (M), yellow (Y), and black (K). Each of the inks is supplied from the corresponding one of ink tanks (not depicted) to the corresponding one of the line heads 4.

As depicted in FIG. 1, each line head 4 of this embodiment includes ten heads 11. The ten heads 11 are arranged zigzag in the medium width direction to form two arrays. Since one color of ink is supplied to one line head 4, said one color of ink is discharged from the ten heads 11 included in said one line head 4. In this embodiment, the line head 4 includes the ten heads 11. The number of the heads 11, however, is not limited to ten.

Figure 2:
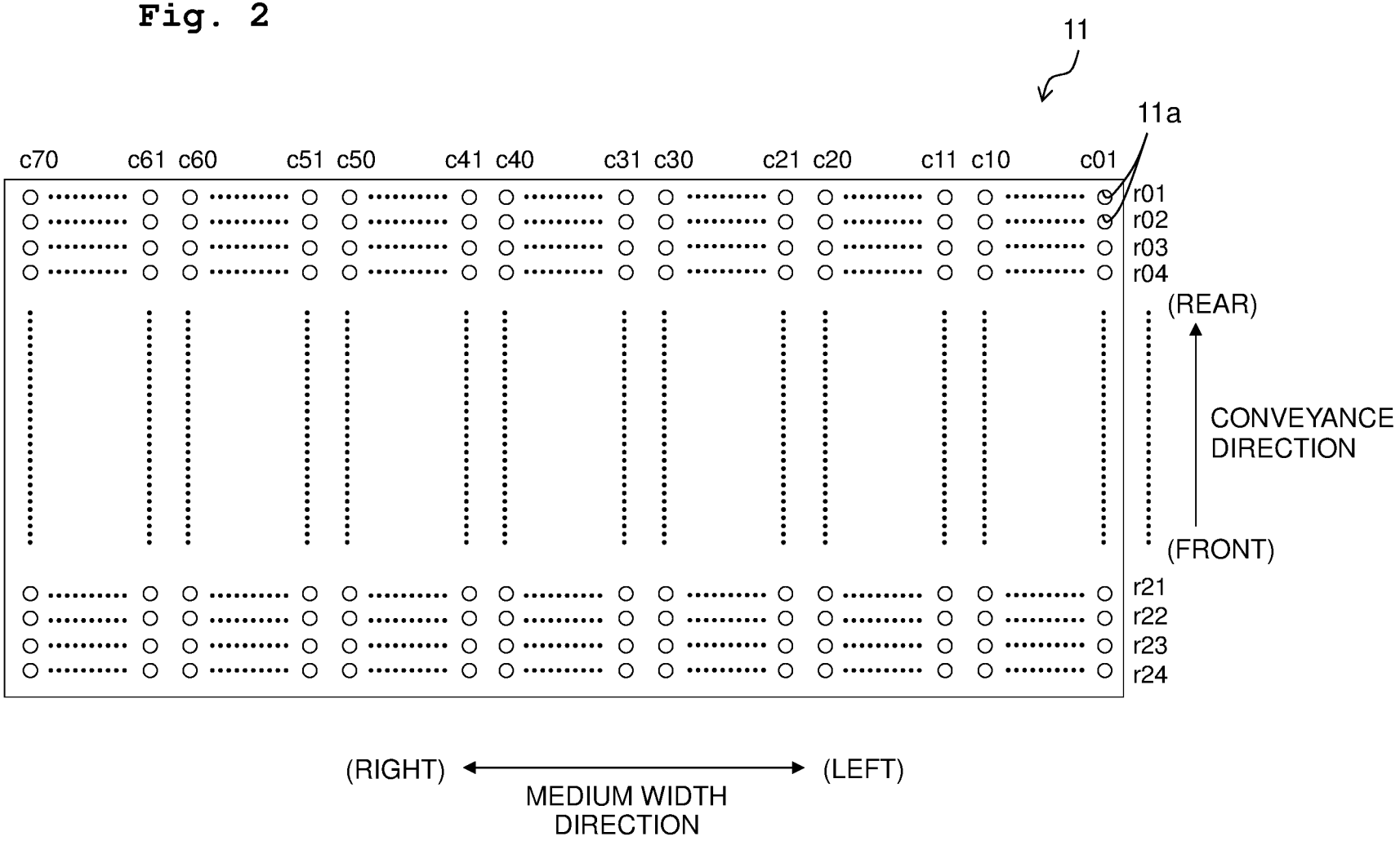
FIG. 2 is a bottom view of an example of a head of this embodiment.

As depicted in FIG. 2, 1680 nozzles 11*a* are opened in a bottom surface of each head 11 in this embodiment. The 1680 nozzles 11*a* form 70 nozzle arrays including nozzle arrays c01 to c70, which are arranged in the medium width direction. Each nozzle array is formed by 24 nozzles 11*a* arranged in the conveyance direction. The positions in the conveyance direction of the nozzles 11*a* are defined as r01 to r24 from the rear side to the front side in the conveyance direction. The position of each nozzle 11*a* in each head 11 is uniquely specified by the nozzle array to which each nozzle 11*a* belongs and the position in the conveyance direction. Although each head 11 includes the 1680 nozzles 11*a* in this embodiment, the number of nozzles 11*a* is not limited to 1680.

Each head 11 includes the same number of driving elements 111 (described below) as the nozzles 11*a*, a second substrate 50, and a flexible circuit board 60. The printing apparatus 1 of this embodiment includes the four line heads 4. Each line head 4 includes the ten heads 11. The printing apparatus 1 thus includes forty heads 11. Accordingly, the number of the second substrates 50 is forty, and the number of flexible circuit boards 60 connected to the second substrates 50 is forty. As depicted in FIG. 3, the first substrate 71 of the controller 7 is connected to the forty second substrates 50. For convenience, only one second substrate 50 and one flexible circuit board 60 are depicted in FIG. 3.

The second substrate 50 includes: the FPGA 51 as a controller, a non-volatile memory 52 such as an EEPROM, a D/A converter 20, power supply circuits 21 to 26, and the like. Although the second substrate 50 includes the six power supply circuits 21 to 26 in this embodiment, the number of the power supply circuits is not limited to six. The flexible circuit board 60 includes a non-volatile memory 62 such as an EEPROM, a driver IC 27, and the like.

Under the control of the FPGA 711 provided in the first substrate 71, the FPGA 51 outputs, to the D/A converter 20, a digital setting signal for setting an output voltage of each of the power supply circuits 21 to 26.

The D/A converter 20 converts the digital setting signal output from the FPGA 51 into an analog setting signal, and then outputs it to each of the power supply circuits 21 to 26.

Each of the power supply circuits 21 to 26 may be configured as a DC/DC converter made using electronic components, such as a FET, an inductor, a resistance, and an electrolytic capacitor. Each of the power supply circuits 21 to 26 outputs, to the driver IC 27, the output voltage designated by the setting signal. All of the power supply circuits 21 to 26 are set to have different output voltages in this embodiment.

The power supply circuit 21 is connected to the driver IC 27 via a trace VDD1. The power supply circuit 22 is connected to the driver IC 27 via a trace VDD2. The power supply circuit 23 is connected to the driver IC 27 via a trace VDD3. The power supply circuit 24 is connected to the driver IC 27 via a trace VDD4. The power supply circuit 25 is connected to the driver IC 27 via a trace VDD5. The power supply circuit 26 is connected to the driver IC 27 via a trace HVDD. The power supply circuit 26 is connected to each driving element 111 described below via a trace VCOM. The traces HVDD and VCOM are branched from an intermediate portion of a trace that is pulled out from the power supply circuit 26.

The power supply circuits 21 to 26 are respectively connected to waveform generating circuits 30(1) to 30(*n*) in the driver IC 27 (n is a natural number equal to or greater than 2, and n is equal to the number of the driving elements 111 in the head unit 11 (i.e., 1680) in this embodiment).

The waveform generating circuits 30(1) to 30(*n*) are provided corresponding to n pieces of the driving element 111 provided in each head 11. Namely, the waveform generating circuits 30(1) to 30(*n*) are provided corresponding to n pieces of the nozzle 11*a* in each head 11. The driver IC 27 is connected to n pieces of signal line 34(1) to 34(*n*). The driver IC 27 is connected to n pieces of the driving element 111 via n pieces of the signal line 34(1) to 34(*n*). Each signal line 34 is connected to an individual electrode of the corresponding driving element 111.

The driver IC 27 includes n pieces of selector 90(1) to 90(*n*) provided corresponding to n pieces of the driving element 111. The selectors 90 are components of hardware that is configured, for example, by a plurality of FETs in the driver IC 27.

The power supply circuit 26 can be used as a power supply voltage for the VCOM of the driving elements 111, or can be used as a high-side back gate voltage (HVDD) of PMOS transistors 311 to 315 described below.

In the non-volatile memory 62, nozzle IDs for identifying the respective nozzles 11*a*, group IDs for identifying nozzle groups (described below) formed by the nozzles 11*a*, column IDs for identifying the nozzle arrays, row IDs for identifying positions in the conveyance direction of the nozzles 11*a*, and the like are stored. Further, for example, as depicted in FIG. 8, a correspondence relationship between n pieces of the nozzle 11*a* and the five power supply circuits 21 to 25, a correspondence relationship between n pieces of the nozzle 11*a* and the groups (group IDs) g10 to g70, a correspondence relationship between n pieces of the nozzle 11*a* and the nozzle arrays (columns IDs) c01 to c70, a correspondence relationship between n pieces of the nozzle 11*a* and the positions in the conveyance direction (row IDs) r01 to r24, and the like are stored as a table T in the non-volatile memory 52. The table T may be stored in the non-volatile memory 62 provided in the flexible circuit board 60 instead of being stored in the non-volatile memory 52.

The driver IC 27 is connected to the FPGA 51 via a control line 40 and n pieces of control line 33(1) to 33(*n*). The control lines 33(1) to 33(*n*) are provided corresponding to n pieces of the waveform generating circuit 30(1) to 30(*n*). A signal for controlling the FET provided for each waveform generating circuit 30 is transmitted to each control line 33. Each waveform generating circuit 30 generates a driving signal for driving each driving element 111 in accordance with the above signal, and the driving signal generated is output to each driving element 111 via the corresponding signal line 34.

A control signal for controlling n pieces of the selector 90(1) to 90(*n*) in the driver IC 27 is transmitted to the control line 40. The FPGA 51 controls n pieces of the selector 90(1) to 90(*n*) and selects a power supply circuit for generating the driving signal to be output to each signal line 34.

Figure 4:
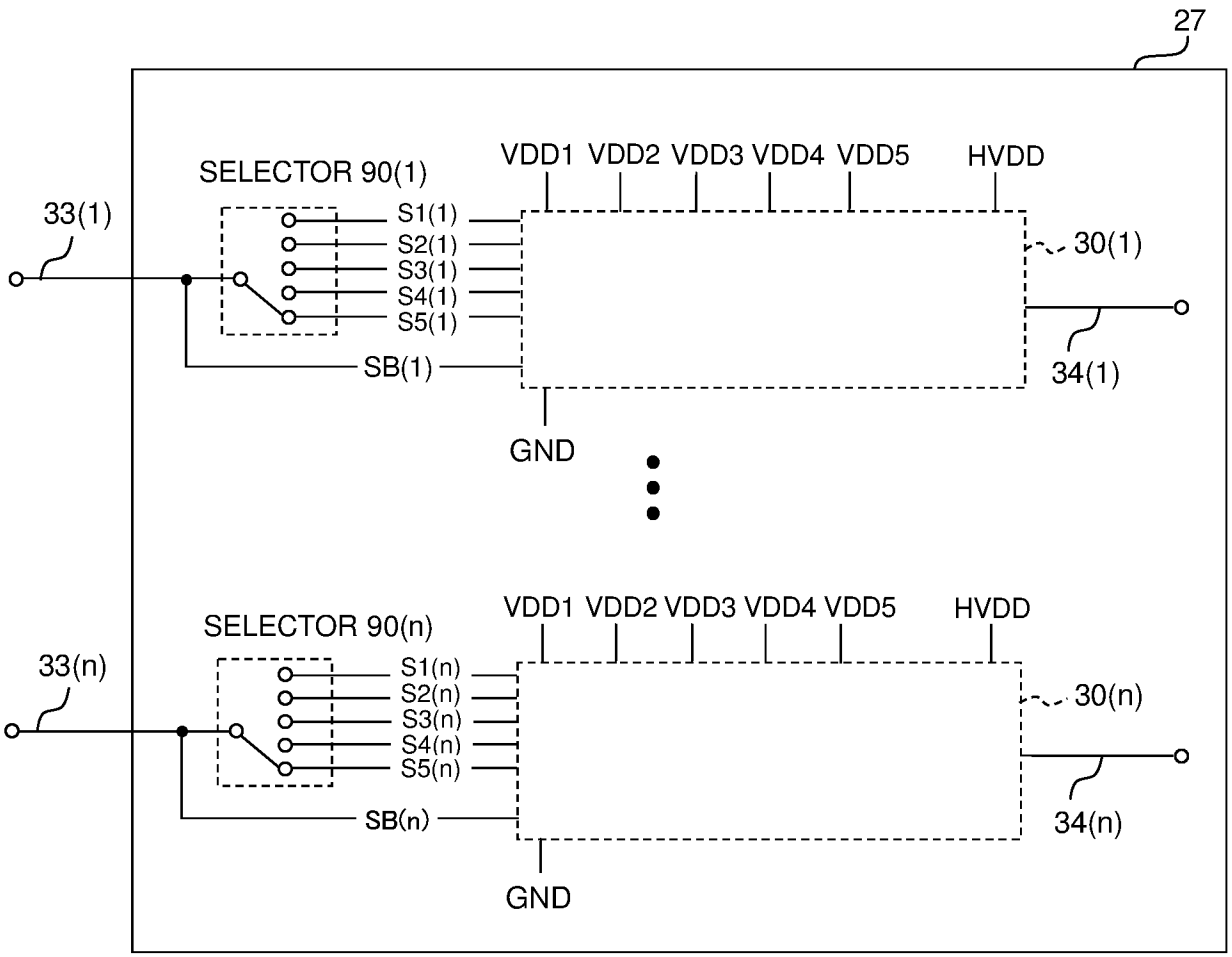
FIG. 4 depicts an example of a circuit configuration provided in a driver IC.

Referring to FIG. 4, an exemplary configuration of the circuit in the driver IC 27 is explained below. As depicted in FIG. 4, the driver IC 27 includes n pieces of the waveform generating circuit 30(1) to 30(*n*), and n pieces of the selector 90(1) to 90(*n*) provided corresponding to the waveform generating circuits 30(1) to 30(*n*), respectively.

The driver IC 27 includes n pieces of the above configuration, the number of which is the same as the number of nozzles. Thus, the configuration of the circuit disposed between the control line 33(1) and the signal line 34(1) is explained below, as a representative. In the driver IC 27, the selector 90(1) and the waveform generating circuit 30(1) are formed between the control line 33(1) and the signal line 34(1).

The control line 33(1) from the FPGA 51 is connected to the selector 90(1). The control line 33(1) is branched from an intermediate portion of a route connecting the FPGA 51 and the selector 90(1), and a control line SB(1) branched from the intermediate portion of the control line 33(1) is connected to the waveform generating circuit 30(1).

The selector 90(1) is connected to the waveform generating circuit 30(1) via five control lines S1(1), S2(1), S3(1), S4(1), and S5(1). The selector 90(1) selects any one of the five control lines S1(1), S2(1), S3(1), S4(1), and S5(1) in accordance with an instruction from the FPGA 51, and connects the selected line to the control line 33(1).

The waveform generating circuit 30(1) is connected to five traces connected to the traces VDD1 to VDD5, a trace connected to the trace HVDD, and a trace connected to a trace GND.

Figure 5:
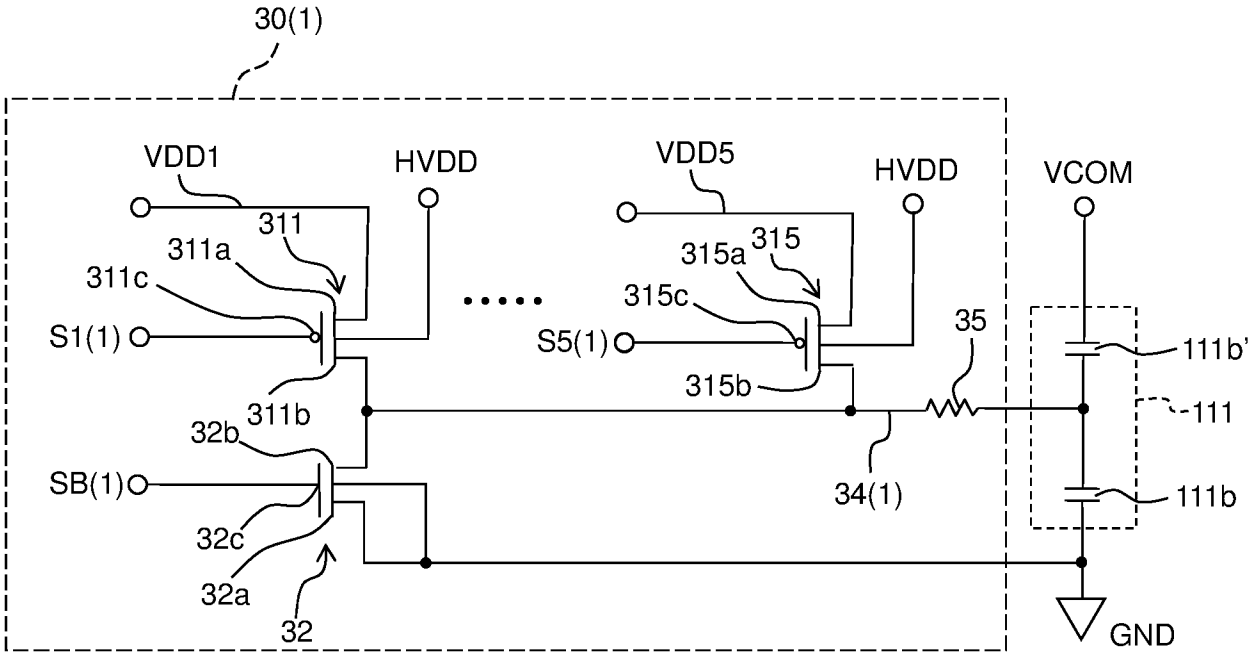
FIG. 5 is a circuit diagram depicting an exemplary configuration of a waveform generating circuit provided in the head of this embodiment.

Referring to FIG. 5, an exemplary circuit configuration of the waveform generating circuits 30(1) to 30(*n*) provided for the head unit 11 according to this embodiment is explained below. Since the waveform generating circuits 30(1) to 30(*n*) have the same configuration, only the waveform generating circuit 30(1) is explained referring to FIG. 5. The waveform generating circuit 30(1) includes five P-type Metal Oxide Semiconductor (PMOS) transistors 311 to 315 (only two transistors are depicted in FIG. 5), a N-type Metal Oxide Semiconductor (NMOS) transistor 32, a resistance 35, and the like. The waveform generating circuit 30(1) is connected to the individual electrode of the driving element 111 via the signal line 34(1).

Each driving element 111 of this embodiment is a piezoelectric element including a first active portion interposed between the individual electrode and a first constant potential electrode and a second active portion interposed between the individual electrode and a second constant potential electrode. Each of the driving elements 111 corresponds to one of pressure chambers. Each driving electrode 111 thus includes a capacitor 111*b* and a capacitor 111*b*'.

Five source terminals 311*a* to 315*a* of the PMOS transistors 311 to 315 are connected to the traces VDD 1 to VDD 5. The source terminal 32*a* of the NMOS transistor 32 is connected to ground. Namely, the PMOS transistor 311 is connected to the power supply circuit 21 via the trace VDD1. The PMOS transistor 312 is connected to the power supply circuit 22 via the trace VDD2. The PMOS transistor 313 is connected to the power supply circuit 23 via the trace VDD5. The PMOS transistor 314 is connected to the power supply circuit 24 via the trace VDD4. The PMOS transistor 315 is connected to the power supply circuit 25 via the trace VDD5.

The control line S1(1) is connected to a gate terminal 311*c* of the PMOS transistor 311. The control line S2(1) is connected to a gate terminal 312*c* of the PMOS transistor 312. The control line S3(1) is connected to a gate terminal 313*c* of the PMOS transistor 313. The control line S4(1) is connected to a gate terminal 314*c* of the PMOS transistor 314. The control line S5(1) is connected to a gate terminal 315*c* of the PMOS transistor 315. The control line SB(1) is connected to a gate terminal 32*c* of the NMOS transistor 32.

Drain terminals 311*b* to 315*b* of the five PMOS transistors 311 to 315 are connected to a first end of the resistance 35. A drain terminal 32*b* of the NMOS transistor 32 is connected to the first end of the resistance 35. A second end of the resistance 35 is connected to the individual electrode of the driving element 111 (a second end of the capacitor 111*b*' and a first end of the capacitor 111*b*). The first constant potential electrode of the driving element 111 (a first end of the capacitor 111*b*') is connected to the VCOM, and the second constant potential electrode of the driving element 111 (a second end of the capacitor 111*b*) is connected to ground.

When the FPGA 51 outputs a low-level signal (L signal) to the control line 33(1), any one of the PMOS transistors 311 to 315 connected to the signal line selected by the selector 90(1) becomes an on state. The capacitor 111*b* is charged with the voltage supplied from any one of the power supply circuits 21 to 25, and the capacitor 111*b*' is discharged. When the FPGA 51 outputs a high-level signal (H signal) to the control line 33(1), the NMOS transistor 32 becomes an on state. The capacitor 111*b*' is charged with the voltage output from any one of the power supply circuits 21 to 25, and the capacitor 111*b* is discharged. The driving element 111 is deformed by alternatingly charging and discharging each of the capacitors 111*b* and 111*b*', which discharges ink from an opening of the corresponding nozzle 11*a*.

Namely, the driving signal for driving the driving element 111 is output to the control line 34(1). The selector 90(1) selects any one of the five control lines S1(1) to S5(1) as the control line to be connected to the control line 33(1), which allows any one of the five power supply circuits 21 to 25 to be selected as the power supply circuit for generating the driving signal.

Figure 6:
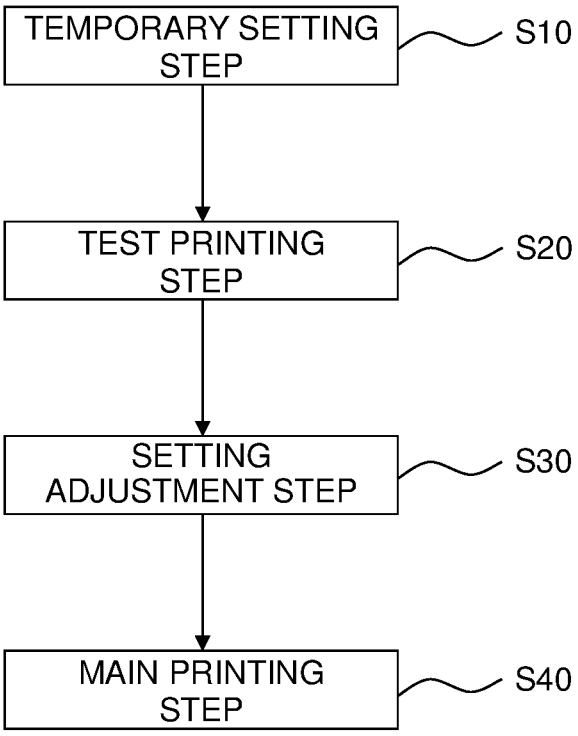
FIG. 6 is a flowchart indicating an outline of a printing method of this embodiment.

Subsequently, a printing method using the printing apparatus 1 of this embodiment is explained below. As depicted in FIG. 6, the printing method using the printing apparatus 1 of this embodiment mainly includes a temporary setting step S10, a test printing step S20, a setting adjustment step S30, and a main printing step S40.

Figure 7:
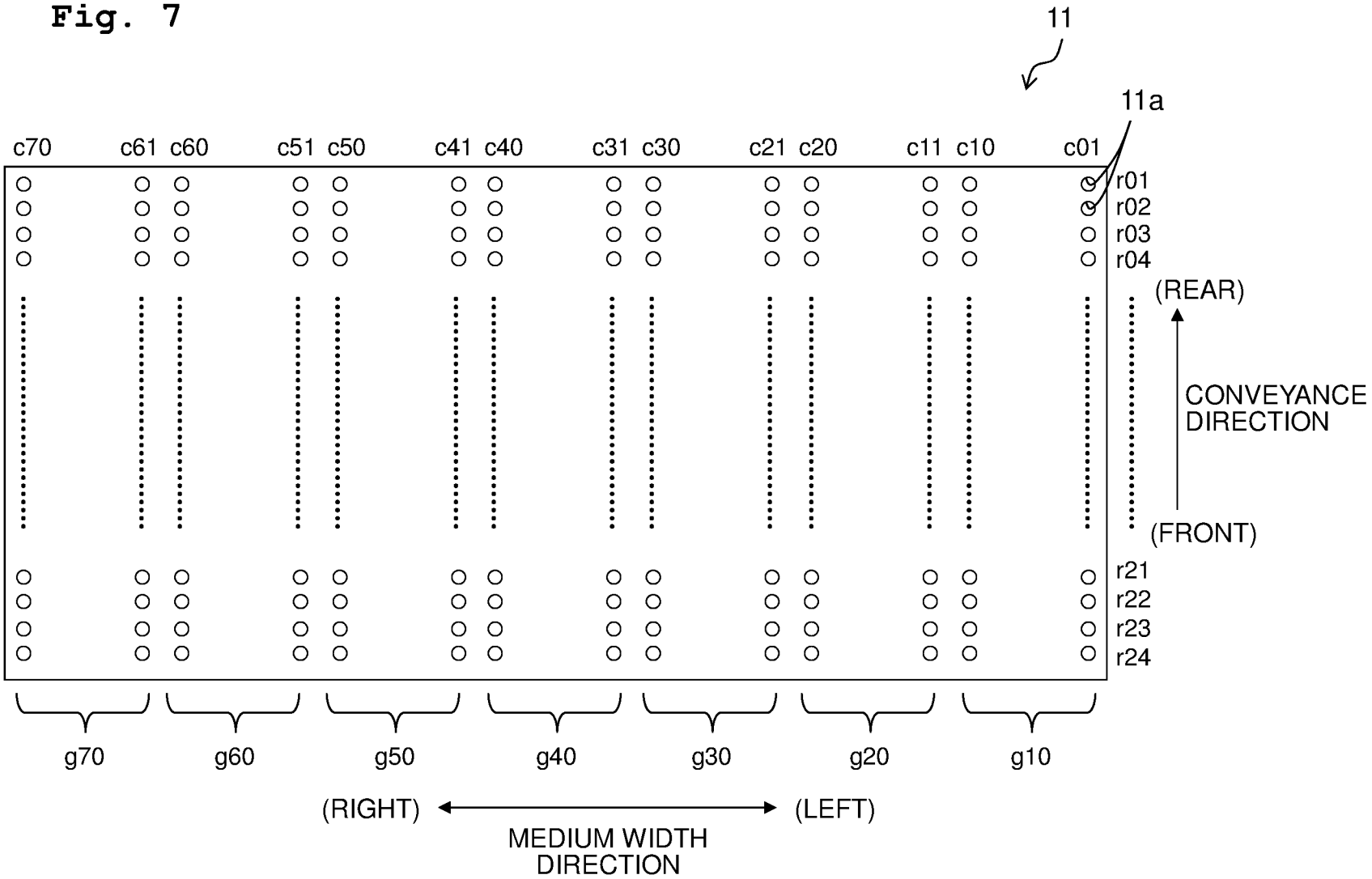
FIG. 7 depicts a state where nozzles are classified into groups in a temporary setting step of the printing method of this embodiment.

In the temporary setting step S10, as depicted in FIG. 7, 1680 nozzles 11*a* are classified into the seven groups g10 to g70 for every 10 nozzle arrays. Namely, the nozzles 11*a* belonging to the nozzle arrays c01 to c10 are associated with the group g10. The nozzles 11*a* belonging to the nozzle arrays c11 to c20 are associated with the group g20. The nozzles 11*a* belonging to the nozzle arrays c21 to c30 are associated with the group g30. The nozzles 11*a* belonging to the nozzle arrays c31 to c40 are associated with the group g40. The nozzles 11*a* belonging to the nozzle arrays c41 to c50 are associated with the group g50. The nozzles 11*a* belonging to the nozzle arrays c51 to c60 are associated with the group g60. The nozzles 11*a* belonging to the nozzle arrays c61 to c70 are associated with the group g70. In this embodiment, the number of the power supply circuits 21 to 26 is six, which is smaller than the number of groups g10 to g 70 (i.e., seven). The number of the power supply circuits may be the same as the number of the groups.

Subsequently, any of the power supply circuits 21 to 25 is allocated to each of the groups so that the seven groups have uniform density of dots formed by the ink droplets discharged from the nozzles 11*a*. For example, the power supply circuit 21 is allocated to the group g10, the power supply circuit 22 is allocated to the group g20, the power supply circuit 23 is allocated to the groups g30 to g50, the power supply circuit 24 is allocated to the group g60, and the power supply circuit 25 is allocated to the group g70. The discharge characteristics of 1680 nozzles 11*a* are affected by a slight error in a diameter of the nozzles 11*a*, a manufacturing error in the driving elements 111, residual stress in the heads 11 generated at the time of manufacture, and the like, and the discharge characteristics of 1680 nozzles 11*a* gradually change depending on the positions in the medium width direction and the conveyance direction. Thus, even if the same power supply circuit is allocated to all the groups, the density of dots formed by ink droplets is not necessarily uniform.

Then, as depicted in FIG. 8, information about the positions (column ID, row ID) of the nozzle 11*a*, the group to which the nozzle 11*a* belongs, and the power supply circuit allocated to the nozzle 11*a* is stored in the non-volatile memory 52 for each of the 1680 nozzles 11*a*. In FIG. 8, v01 to v05 indicate identifies of the power supply circuits 21 to 25.

In the test printing step S20, test printing is performed on the medium P in accordance with the allocation of the power circuit set in the temporary setting step S10. Specifically, voltage is supplied from the power supply circuit 21 to the driving elements 111 corresponding to the nozzles 11*a* included in the group g10. Voltage is supplied from the power supply circuit 22 to the driving elements 111 corresponding to the nozzles 11*a* included in the group g20. Voltage is supplied from the power supply circuit 23 to the driving elements 111 corresponding to the nozzles 11*a* included in the groups g30 to g50. Voltage is supplied from the power supply circuit 24 to the driving elements 111 corresponding to the nozzles 11*a* included in the group g60. Voltage is supplied from the power supply circuit 25 to the driving elements 111 corresponding to the nozzles 11*a* included in the group g70. Test printing is performed on the medium P by discharging ink droplets from the 1680 nozzles 11*a* included in the groups g10 to g70.

In the setting adjustment step S30, the allocation of the power supply circuit set in the temporary setting step S10 is corrected based on the printing result in the test printing step S20. In the temporary setting step S10, the power supply circuit is allocated to each group. Thus, the density of dots formed by the ink droplets discharged from the nozzles 11*a* included in the same group hardly varies. However, when different power supply circuits are allocated to two groups adjacent to each other in the medium width direction (e.g., the first group g10 and the second group g20), the dots formed by ink droplets discharged from the nozzles 11*a* in the vicinity of the boundary between the two groups (e.g., the nozzle array c10 and the nozzle array c11) may have the difference in density enough to be seen with the naked eye. In view of this, in the setting adjustment step S30, a user observes the printing result in the test printing step S20 with the naked eye, and determines whether the density difference is generated along the boundary between the two groups adjacent to each other in the medium width direction. When such a density difference is not generated (when the user sees no density difference with the naked eye), the allocation of the power supply circuit in the temporary setting step S10 is maintained, and the main printing step S40 is performed. When the density difference is generated (when the user sees the density difference with the naked eye), the allocation of the power supply circuit in the temporary setting step S10 is adjusted. A specific example thereof is explained below.

Figure 9:
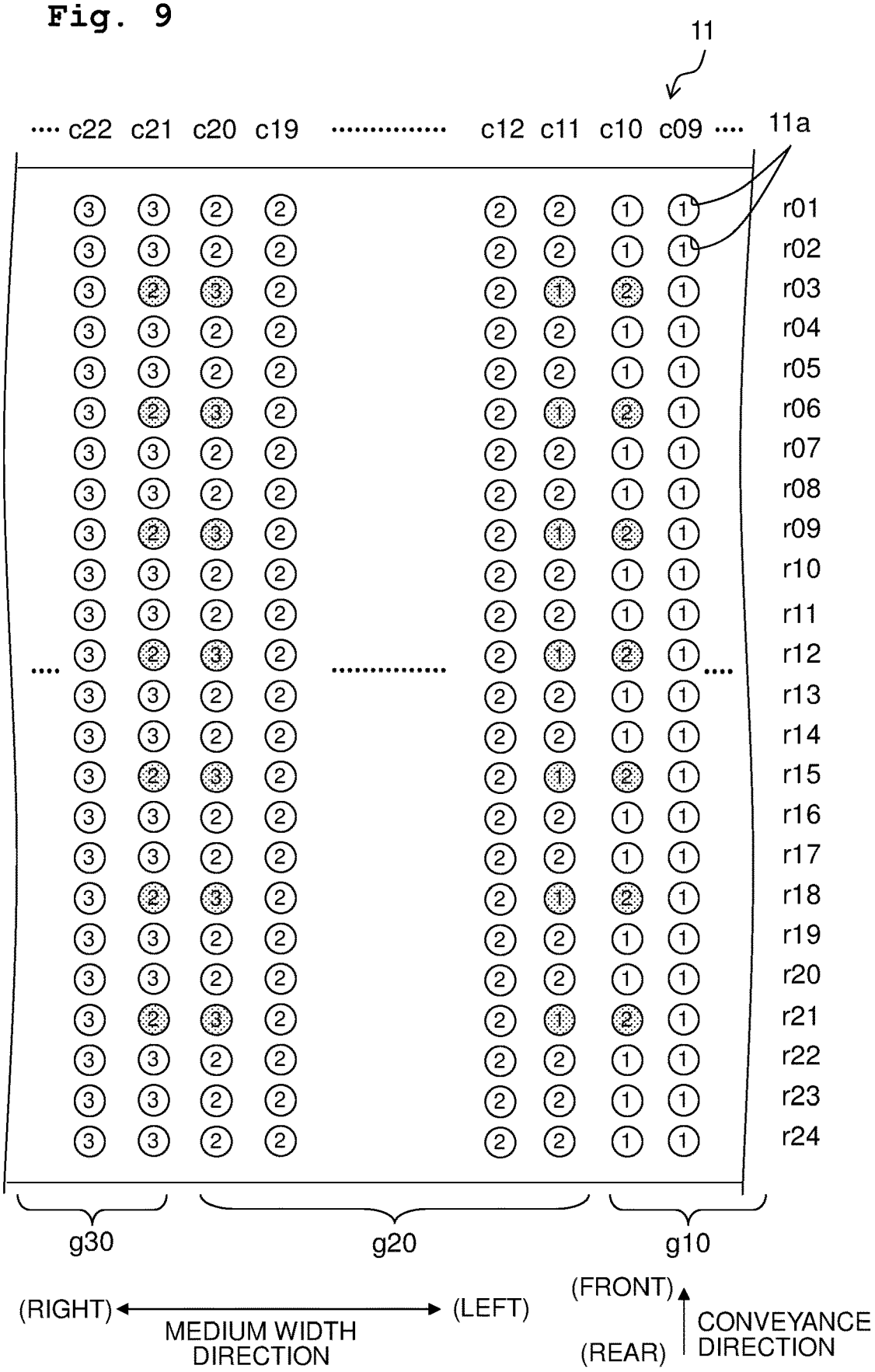
FIG. 9 depicts a state where allocation of a power supply circuit to some of the nozzles is changed in a setting adjustment step of the printing method of this embodiment.

For example, when the user recognizes that the density difference is generated along the boundary between the group g20 and the group g30 depicted in FIG. 7 by observing the printing result in the test printing step S20 with the naked eye, the allocation of the power circuit is adjusted for the nozzle array c20 included in the group g20 and the nozzle array c21 included in the group g30. For example, as depicted in FIG. 9, in some of the rows (r03, r06, r09, r12, r15, r18, r21) of the nozzle arrays c20 and c21, the exchange of the power supply circuit allocated thereto is performed. Namely, in the nozzle array c20, the power supply circuit 22 allocated to the nozzles 11*a* positioned in the rows r03, r06, r09, r12, r15, r18, and r21 is changed to the power supply circuit 23 allocated to the group g30 adjacent to the nozzle array c20. Further, in the nozzle array c21, the power supply circuit 23 allocated to the nozzles 11*a* positioned in the rows r03, r06, r09, r12, r15, r18, and r21 is changed to the power supply circuit 22 allocated to the group g20 adjacent to the nozzle array c21. In this case, the number of the nozzles 11*a* with which the group g20 is associated and to which the power supply circuit 22 is allocated is larger than the number of the nozzles 11*a* with which the group g20 is associated and to which the power supply circuit 23 is allocated. Further, when the user recognizes that the density difference is generated along the boundary between the group g10 and the group g20 depicted in FIG. 7, the allocation of the power circuit is adjusted for the nozzle array c10 included in the group g10 and the nozzle array c11 included in the group g20. Namely, in the nozzle array c10, the power supply circuit 21 allocated to the nozzles 11*a* positioned in the rows r03, r06, r09, r12, r15, r18, and r21 is changed to the power supply circuit 22 allocated to the group g20 adjacent to the nozzle array c10. Further, in the nozzle array c11, the power supply circuit 22 allocated to the nozzles 11*a* positioned in the rows r03, r06, r09, r12, r15, r18, and r21 is changed to the power supply circuit 21 allocated to the group g10 adjacent to the nozzle array c11. In this case, the number of the nozzles 11*a* with which the group g20 is associated and to which the power supply circuit 22 is allocated is larger than the number of the nozzles 11*a* with which the group g20 is associated and to which the power supply circuit 21 is allocated. In FIG. 9, a number in each circle representing the nozzle 11*a* indicates the last digit of a number of the power supply circuit allocated to the nozzle 11*a*. Each nozzle 11*a* hatched represents the nozzle 11*a* in which the allocation of the power supply circuit is changed. The allocated power supply circuit is changed by rewriting a power supply circuit ID, which is stored in the non-volatile memory 52 depicted in FIG. 8, for the corresponding nozzle 11*a*.

In the above specified example, the group g20 is an exemplary "first group" of the present disclosure, the group g30 is an exemplary "second group" of the present disclosure, and the group g10 is an exemplary "third group" of the present disclosure. In the temporary setting step S10, the power supply circuit 22 allocated to the group g20 is an exemplary "first power supply circuit" of the present disclosure, the power supply circuit 23 allocated to the group g30 is an exemplary "second power supply circuit" of the present disclosure, and the power supply circuit 21 allocated to the group g10 is an exemplary "third power supply circuit" of the present disclosure. The nozzle array c20 included in the group g20 and adjacent to the group g30 is an exemplary "first nozzle array" of the present disclosure.

In the main printing step S40, voltage is supplied to the driving element 111 corresponding to each nozzle 11*a* in accordance with the allocation information of the power supply circuit stored in the non-volatile memory 52. Then, printing is performed for the medium P by discharging ink droplets from the 1680 nozzles 11*a* included in the groups g10 to g70.

In the above embodiment, when the user recognizes that the density difference is generated along the boundary between any two groups adjacent to each other in the medium width direction by observing the printing result in the test printing step S20 with the naked eye, the allocation of the power supply circuit is changed for some of the nozzles forming the boundary. Specifically, for some of the nozzles 11*a* belonging to the nozzle array that is included in one of the two groups and that is adjacent to the other group, the power supply circuit allocated to the other group is allocated. For some of the nozzles 11*a* belonging to the nozzle array that is included in the other group and that is adjacent to the one of the two groups, the power supply circuit allocated to the one of the two groups is allocated. This reduces the density difference generated at the boundary between the two groups.

In the above embodiment, the density difference at the boundary between two groups is reduced by adjusting the allocation of the power supply circuit set in advance without correcting the output voltage value of the power supply circuit itself. Since the output voltage value of the power supply circuit is not required to be adjustable, the increase in manufacturing cost is inhibited.

The embodiment as described above is merely an example, and may be modified as appropriate. In the above embodiment, the exchange of the power supply circuit is performed for the nozzles 11*a* that belong to the nozzle arrays c20 and c21 and are positioned at the specified positions (r03, r06, r09, r12, r15, r18, r21) in the conveyance direction. In the two nozzle arrays, the number of the nozzles 11*a* for which the exchange of the power supply circuit is performed and the positions in the conveyance direction of the nozzles 11*a* for which the exchange of the power supply circuit is performed may be changed appropriately.

In the above embodiment, the nozzle arrays c20 and c21 have the same positions in the conveyance direction of the nozzles 11*a* for which the exchange of the power supply circuit is performed. The two nozzle arrays may have different positions in the conveyance direction of the nozzles 11*a* for which the exchange of the power supply circuit is performed. For example, in the nozzle array c20, the exchange of the power supply circuit may be performed for the nozzles 11*a* positioned in the rows r03, r06, r09, r12, r15, r18, and r21. In the nozzle array c21, the exchange of the power supply circuit may be performed for the nozzles 11*a* positioned in the rows r04, r07, r10, r13, r16, r19, and r22.

In the above embodiment, the exchange of the power supply circuit is performed for both the nozzle array c20 and the nozzle array c21. However, the exchange of the power supply circuit may be performed for only one of the two nozzle arrays. For example, the allocation of the power supply circuit may not be changed in the nozzle array c21, and the allocation of the power supply circuit may be changed for only some of the nozzles 11*a* included in the nozzle array c20.

Figure 10:
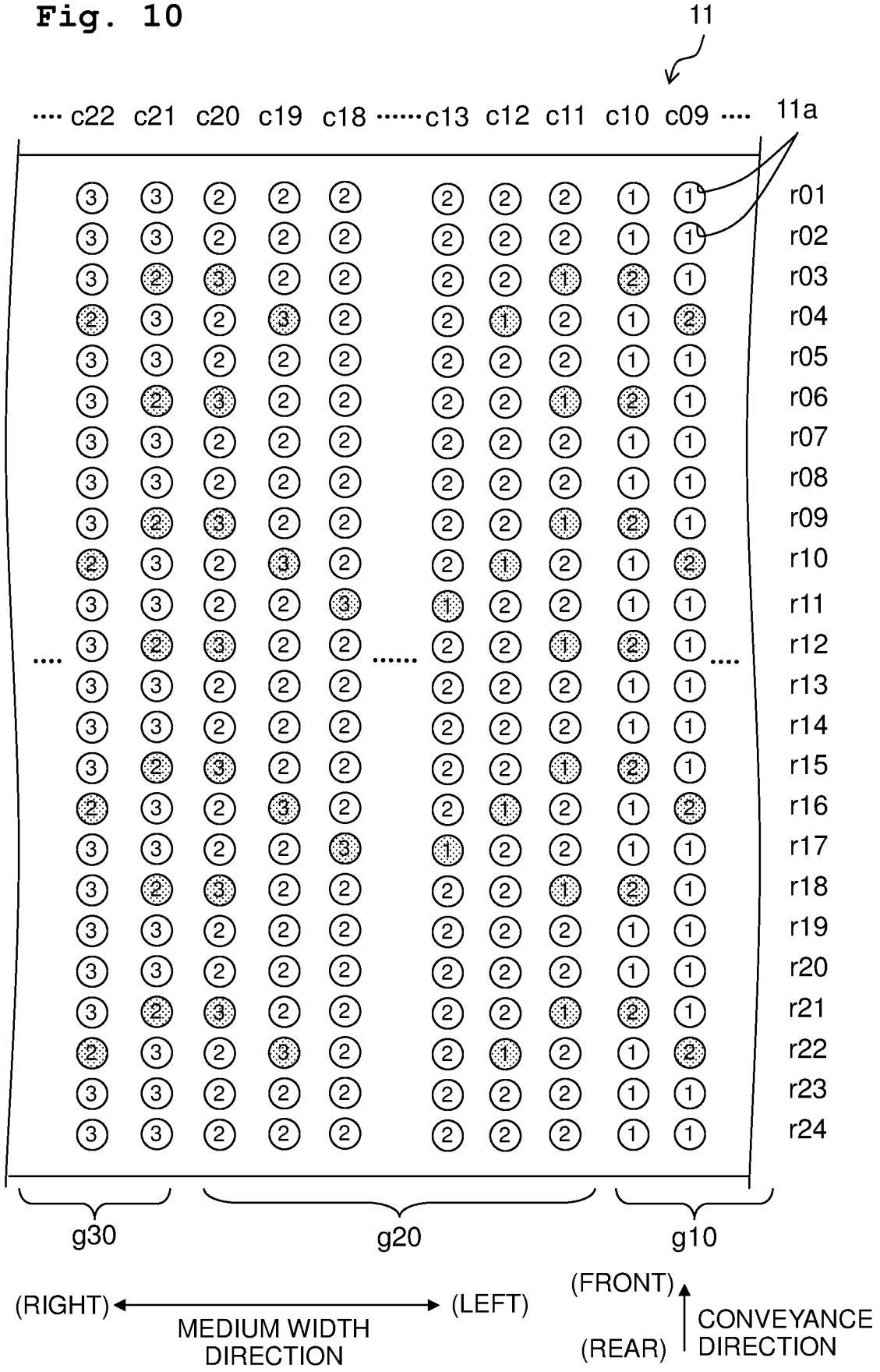
FIG. 10 depicts the first modified example of a method for changing the allocation of the power supply circuit in this embodiment.

In the above embodiment, the allocation of the power supply circuit is adjusted in the nozzle array c20 included in the group g20 and the nozzle array c21 included in the group g30. However, the allocation of the power supply circuit may be adjusted in nozzle arrays included in the group g20 and nozzle arrays included in the group g30. For example, as depicted in FIG. 10, in the group g20, the allocation of the power supply circuit may be adjusted not only in the nozzle array c20 but also in the nozzle arrays c19 and c18. Similarly, in the group g30 adjacent to the group g20, the allocation of the power supply circuit may be adjusted not only in the nozzle array c21 but also in the nozzle array c22, and the like. In this case, the power supply circuit 23 is allocated to seven rows r03, r06, r09, r12, r15, r18, and r21 in the nozzle array c20, the power supply circuit 23 is allocated to four rows r04, r10, r16, and r22 in the nozzle array c19, and the power supply circuit 23 is allocated to two rows r11 and r17 in the nozzle array c18. Similarly, the power supply circuit 22 is allocated to seven rows r03, r06, r09, r12, r15, r18, and r21 in the nozzle array c21, and the power supply circuit 22 is allocated to four rows r07, r10, r16, and r22 in the nozzle array c22. Namely, the number of the nozzles 11*a* in the group g20 to which the power supply circuit 23 is allocated is smaller with distance from the group g30 in the medium width direction. Similarly, the number of the nozzles 11*a* in the group g30 to which the power supply circuit 22 is allocated is smaller with distance from the group g20 in the medium width direction.

It is only required that the number of the nozzles 11*a* in the nozzle array c19 in which the allocation of the power supply circuit is adjusted is equal to or less than the number of the nozzles 11*a* in the nozzle array c20 in which the allocation of the power supply circuit is adjusted. It is only required that the number of the nozzles 11*a* in the nozzle array c18 in which the allocation of the power supply circuit is adjusted is equal to or less than the number of the nozzles 11*a* in the nozzle array c19 in which the allocation of the power supply circuit is adjusted. Similarly, for the group g30, it is only required that the number of the nozzles 11*a* in the nozzle array c22 in which the allocation of the power supply circuit is adjusted is equal to or less than the number of the nozzles 11*a* in the nozzle array c21 in which the allocation of the power supply circuit is adjusted.

In the modified example depicted in FIG. 10, the nozzle array c19 included in the group g20 is an exemplary "second nozzle array" of the present disclosure. The nozzle array c18 that is included in the group g20 and that is farther from the group g30 in the medium width direction than the nozzle array c19 is an exemplary "third nozzle array" of the present disclosure. The nozzle array c21 that is included in the group g30 is an exemplary "fourth nozzle array" of the present disclosure. The nozzle array c22 that is included in the group g30 and that is farther from the group g20 in the medium width direction than the nozzle array c21 is an exemplary "fifth nozzle array" of the present disclosure.

Figure 11:
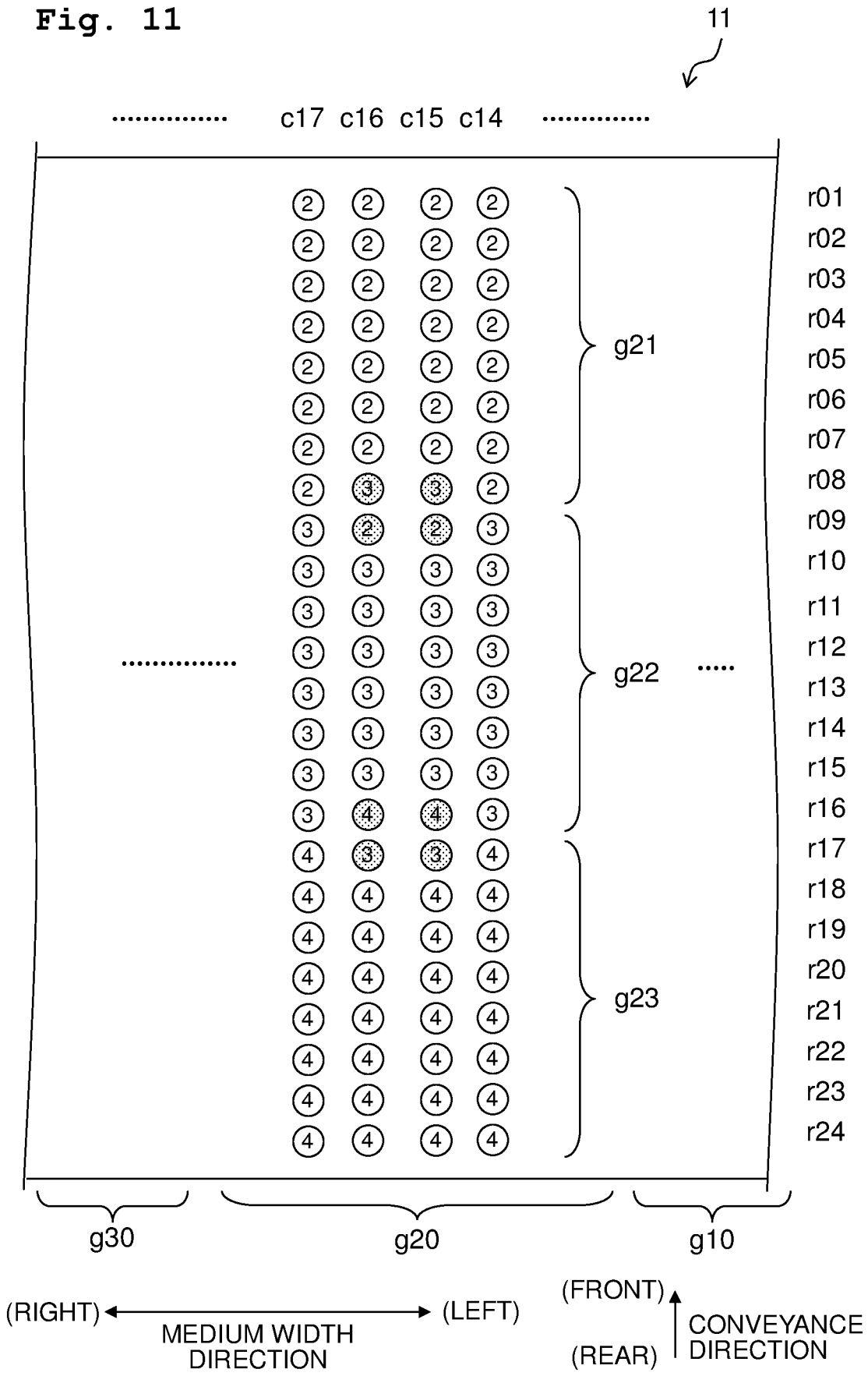
FIG. 11 is the second modified example of the method for changing the allocation of the power supply circuit in this embodiment.

In the temporary setting step S10 of the above embodiment, the 1680 nozzles 11*a* are classified into the seven groups g10 to g70 for every 10 nozzle arrays. However, each of the seven groups g10 to g70 may be further classified into more groups for every multiple nozzle arrays along the conveyance direction. For example, as depicted in FIG. 11, in the group g20, the rows r01 to r08 may be defined as the group g21, the rows r09 to r16 may be defined as the group g22, the rows r17 to r24 may be defined as the group g23, the power supply circuit 22 may be allocated to the group g21, the power supply circuit 23 may be allocated to the group g22, and the power supply circuit 24 may be allocated to the group g23. In the setting adjustment step S30, the allocation of the power supply circuit may be adjusted also at the boundary between the two groups adjacent to each other in the conveyance direction, based on the printing result in the test printing step S20. For example, the allocation of the power supply circuit may be adjusted in the nozzles 11*a* hatched in FIG. 11. Namely, in the group g21, the power supply circuit 22 allocated to some of the nozzles 11*a* positioned in the row r08 is changed to the power supply circuit 23. In the group g22, the power supply circuit 23 allocated to some of the nozzles 11*a* positioned in the row r09 is changed to the power supply circuit 22. Similarly, in the group g22, the power supply circuit 23 allocated to some of the nozzles 11*a* positioned in the row r16 is changed to the power supply circuit 24. In the group g23, the power supply circuit 24 allocated to some of the nozzles 11*a* positioned in the row r17 is changed to the power supply circuit 23. In this modified example, the group g22 is an exemplary "first group" of the present disclosure, and the group g23 is an exemplary "fourth group" of the present disclosure. Further, the power supply circuit 24 is an exemplary "fourth power supply circuit" of the present disclosure.

In the above embodiment, as depicted in FIG. 9, the allocation of the power supply circuit is adjusted, for example, in the nozzle array c10 included in the group g10, the nozzle arrays c11 and c20 included in the group g20, and the nozzle array c21 included in the group g30. The allocation of the power supply circuit is not adjusted in any other nozzle arrays than the above. Therefore, in the temporary setting step S10, groups in which the adjustment of allocation of the power supply circuit is not performed and groups that allow the adjustment of allocation of the power supply circuit may be defined in advance. For example, a pair of nozzle arrays c10 and c11, a pair of nozzle arrays c20 and c21, a pair of nozzle arrays c30 and c31, a pair of nozzle arrays c40 and c41, a pair of nozzle arrays c50 and c51, and a pair of nozzle arrays c60 and c61, the nozzle arrays in each pair being adjacent to each other in the medium width direction, may be defined as the group g15, g25, g35, g45, g55, and g65 that allow the adjustment of the allocation of the power supply circuit. Any other nozzle arrays than the above may be defined as the groups g10, g20, g30, g40, g50, g60, and g70 in which the adjustment of allocation of the power supply circuit is not performed. In this case, for example, the power supply circuit 22 allocated to the group g20 and the power supply circuit 23 allocated to the group g30 are mixed in the group g25 formed by the pair of nozzle arrays c20 and c21. In this modified example, for example, the group g25 is an exemplary "first group" of the present disclosure, the group g20 is an exemplary "second group of the present disclosure, and the group g30 is an exemplary "third group" of the present disclosure. The power supply circuit 22 allocated to the group g20 is an exemplary "first power supply circuit" of the present disclosure, and the power supply circuit 23 allocated to the group g30 is an exemplary "second power supply circuit" of the present disclosure.

In the temporary setting step S10 of the above embodiment, each of the seven groups g10 to g70 is defined for every 10 nozzle arrays, and any one of the power supply circuits 21 to 25 is allocated to each group. However, defining the groups is not necessarily required, and any of the power supply circuits 21 to 25 may be allocated to each nozzle array. For example, the power supply circuit 22 may be allocated to each of the nozzle arrays c11 to c20, and the power supply circuit 23 may be allocated to each of the nozzle arrays c21 to c30. Further, in the setting adjustment step S30, for example, the allocation of the power supply circuit 22 for the nozzles 11*a* belonging to the nozzle arrays c12 to c19 may not be changed, the allocation of the power supply circuit 22 and the power supply circuit 23 may be exchanged in some of the nozzles 11*a* belonging to the nozzle array c20 and the nozzle array c21, and the allocation of the power supply circuit 23 for the nozzles 11*a* belonging to the nozzle arrays c22 to c29 may not be changed. In this case, each of the nozzle arrays c20 and c21 is an example of "at least one boundary nozzle array" of the present disclosure. When any one of the power supply circuits 21 to 25 is allocated to each of the nozzle arrays, in the adjustment setting step S30, only the power circuit 22 allocated to some of the nozzles 11*a* belonging to the nozzle array c20 may be changed to the power supply circuit 23. Namely, after the adjustment setting step S30, the nozzles 11*a* to which the power supply circuit 22 is allocated and the nozzles 11*a* to which the power supply circuit 23 is allocated may be mixed in the nozzle array c20.

Figure 12:
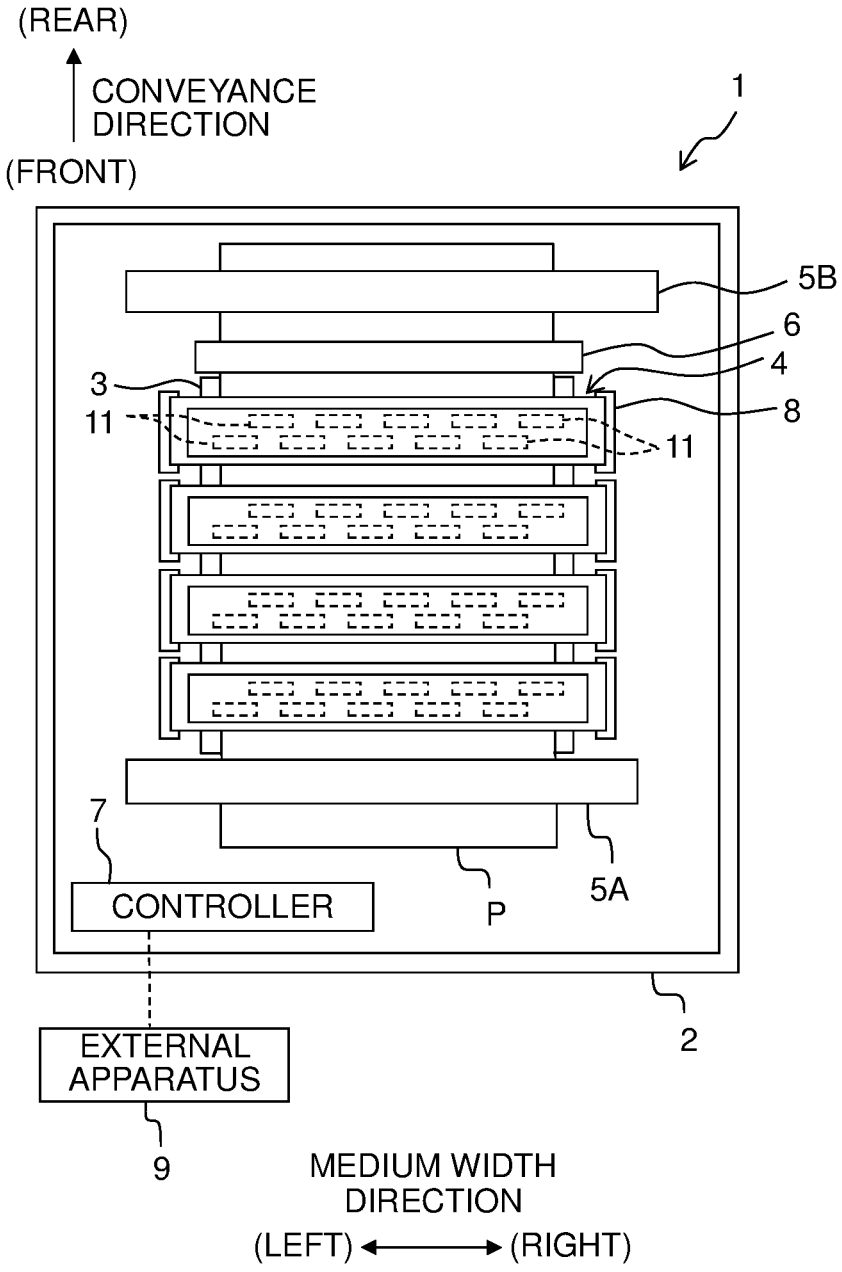
FIG. 12 is a plan view of a modified example of the main configuration of the printing apparatus of this embodiment.

In the above embodiment, the allocation of the power supply circuit is temporarily set in the temporary setting step S10, and test printing is performed in the test printing step S20. Then, in the setting adjustment step S30, the allocation of the power supply circuit is adjusted based on the printing result of the test printing step S20. The present disclosure, however, is not limited thereto. For example, after the temporary setting step S10, the main printing step S40 may be performed without performing the test printing step S20 and the setting adjustment step S30. During the main printing step S40, the allocation of the power supply circuit may be adjusted depending on the printing result. In this case, for example, as depicted in FIG. 12, a density sensor 6 may be provided at a downstream side from four line heads 4 in the conveyance direction, and the density sensor 6 may detect density at positions in the medium width direction during main printing. When the density difference between the two positions adjacent to each other in the conveyance direction exceeds a predefined threshold value, the allocation of the power supply circuit may be changed in the nozzle arrays corresponding to the two positions.

In the above embodiment, the printing apparatus 1 performs printing on the medium P by a line head system in which ink is discharged from the line heads 4 that are fixed to the printing apparatus 1 and that are long in the medium width direction. However, the printing apparatus 1 may perform printing on the medium P by a serial head system in which the carriage moves the heads 11 in the medium width direction.

In the above embodiment, the medium P is conveyed with the line heads 4 being fixed to the printing apparatus 1. The present disclosure, however, is not limited thereto. It is only required that the medium P moves relative to the line heads 4. For example, the line heads 4 may be configured to move relative to the fixed medium P.

What is claimed is:

1. A printing apparatus comprising:

a plurality of power supply circuits including at least a first power supply circuit and a second power supply circuit;

a head including a plurality of nozzles, the nozzles forming a plurality of groups arranged in a first direction, each of the groups including a plurality of nozzle arrays arranged in the first direction, each of the nozzle arrays extending in a second direction intersecting with the first direction, and each of the nozzles being associated with any of the power supply circuits; and a memory storing information indicating:

a correspondence relationship between the nozzles and the power supply circuits;

a correspondence relationship between the nozzles and the groups; and a correspondence relationship between the nozzles and the nozzle arrays, wherein:

printing is performed by driving the head based on the information;

the groups include a first group and a second group adjacent to each other in the first direction;

the first group includes a first nozzle array adjacent to the second group in the first direction; and the information indicates that a plurality of nozzles that are associated with the first group include a plurality of nozzles associated with the first power supply circuit and a plurality of nozzles associated with the second power supply circuit, and indicates that a plurality of nozzles associated with the first nozzle array include some of the nozzles associated with the second power supply circuit.

2. The printing apparatus according to claim 1, wherein the information indicates that a number of nozzles associated with the first group and associated with the first power supply circuit is larger than a number of nozzles associated with the first group and associated with the second power supply circuit.

3. The printing apparatus according to claim 1, wherein a number of the power supply circuits is equal to or less than the number of the groups.

4. The printing apparatus according to claim 1, wherein the first group further includes a second nozzle array and a third nozzle array that is farther in the first direction from the second group than the second nozzle array, the information indicates that a number of nozzles associated with the third nozzle array and associated with the second power supply circuit is equal to or less than a number of nozzles associated with the second nozzle array and associated with the second power supply circuit.

5. The printing apparatus according to claim 4, wherein the second group includes a fourth nozzle array and a fifth nozzle array that is farther in the first direction from the first group than the fourth nozzle array, and the information indicates that a number of nozzles associated with the fifth nozzle array and associated with the first power supply circuit is equal to or less than a number of nozzles associated with the fourth nozzle array and associated with the first power supply circuit.

6. The printing apparatus according to claim 1, wherein the groups further include a third group that is adjacent to the first group in the first direction on an opposite side of the second group, the power supply circuits further include a third power supply circuit, and the information indicates that the nozzles associated with the first group further include a plurality of nozzles associated with the third power supply circuit.

7. The printing apparatus according to claim 6, wherein the nozzles further form a fourth group that is adjacent to the first group in the second direction, the power supply circuits further include a fourth power supply circuit, and the information indicates that the nozzles associated with the first group further include a plurality of nozzles associated with the fourth power supply circuit.

8. A printing apparatus, comprising:

a plurality of power supply circuits including at least a first power supply circuit and a second power supply circuit;

a head including a plurality of nozzles, the nozzles forming a plurality of groups arranged in a first direction, each of the nozzles being associated with any of the power supply circuits; and a memory storing information indicating a correspondence relationship between the nozzles and the power supply circuits and a correspondence relationship between the nozzles and the groups, wherein:

printing is performed by driving the head based on the information;

the groups include a first group, a second group, and a third group, the second and third group being adjacent to the first group at both sides in the first direction; and the information indicates that a plurality of nozzles associated with the first group include at least one nozzle associated with the first power supply circuit and at least one nozzle associated with the second power supply circuit, that all nozzles associated with the second group are associated with the first power supply circuit, and that all nozzles associated with the third group are associated with the second power supply circuit.

9. A printing apparatus, comprising:

a plurality of power supply circuits including at least a first power supply circuit and a second power supply circuit;

a head including a plurality of nozzles, the nozzles forming a plurality of nozzle arrays arranged in a first direction, each of the nozzle arrays extending in a second direction intersecting with the first direction, and each of the nozzles being associated with any of the power supply circuits; and a memory storing information indicating a correspondence relationship between the nozzles and the power supply circuits and a correspondence relationship between the nozzles and the nozzle arrays, wherein printing is performed by driving the head based on the information, wherein the information indicates that the nozzle arrays include:

at least one boundary nozzle array formed by a plurality of nozzles associated with the first power supply circuit and a plurality of nozzles associated with the second power supply circuit;

at least one nozzle array positioned at one side in the first direction with respect to the at least one boundary nozzle array and formed only by the nozzles associated with the first power supply circuit; and at least one nozzle array positioned at the other side in the first direction with respect to the at least one boundary nozzle array and formed only by the nozzles associated with the second power supply circuit.

10. A printing method, comprising:

discharging liquid from a head onto a medium, the head including: a plurality of power supply circuits that include at least a first power supply circuit and a second power supply circuit; and a plurality of nozzles, the nozzles forming a plurality of groups arranged in a first direction, each of the groups including a plurality of nozzle arrays arranged in the first direction, each of the nozzle arrays extending in a second direction intersecting with the first direction, each of the nozzles being associated with any of the power supply circuits; and moving one of the medium and the nozzles relative to the other of the medium and the nozzles, wherein:

the groups include a first group and a second group adjacent to each other in the first direction;

the first group includes a first nozzle array adjacent to the second group in the first direction;

a plurality of nozzles belonging to the first group include a plurality of nozzles associated with the first power supply circuit and a plurality of nozzles associated with the second power supply circuit; and the nozzles belonging to the first nozzle array include some of the nozzles associated with the second power supply circuit.

* * * * *